United States Patent [19]

Kuchenbecker

[11] 4,300,682

[45] Nov. 17, 1981

[54] BLISTER PACKAGE

[75] Inventor: Morris W. Kuchenbecker, Neenah, Wis.

[73] Assignee: American Can Company, Greenwich, Conn.

[21] Appl. No.: 162,189

[22] Filed: Jun. 23, 1980

Related U.S. Application Data

[63] Continuation-in-part of Ser. No. 40,100, May 18, 1979, Pat. No. 4,236,636.

[51] Int. Cl.[3] ..... B65D 83/00; B65D 65/16; B65D 75/58

[52] U.S. Cl. ..... 206/461; 206/467; 206/470; 206/621; 206/626

[58] Field of Search ..... 206/461, 467, 470, 621, 206/626; 229/45

[56] References Cited

U.S. PATENT DOCUMENTS

| | | | |
|---|---|---|---|
| 3,127,010 | 3/1964 | Capezzuto | 206/626 |
| 3,139,182 | 6/1964 | Edell | 206/471 |
| 3,288,349 | 11/1966 | Palmer et al. | 229/45 |
| 3,869,043 | 3/1975 | Warner et al. | 206/468 |
| 4,119,203 | 10/1978 | Kuchenbecker | 206/621 |

*Primary Examiner*—William T. Dixson, Jr.
*Attorney, Agent, or Firm*—Robert P. Auber; Stuart S. Bowie; Thomas D. Wilhelm

[57] ABSTRACT

A blister card package has a product with an enlarged portion, and a conforming blister. Interference between the resilient blister and the enlarged portion retains the product in the package when the product is subjected to moderate removal forces, such as gravity. The product may also be returned to the package for resilient retainment and storage.

5 Claims, 14 Drawing Figures

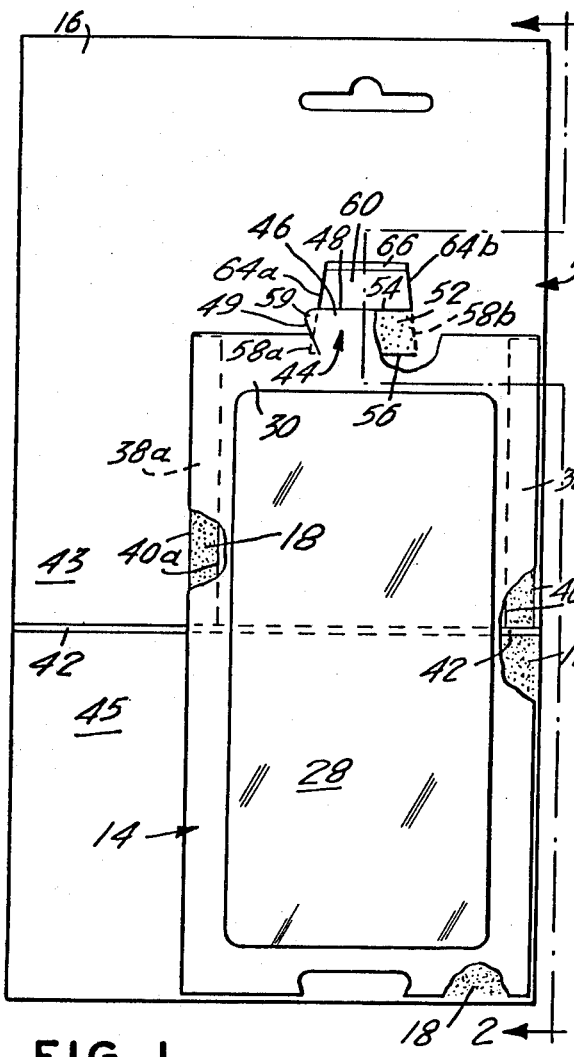
FIG. 1
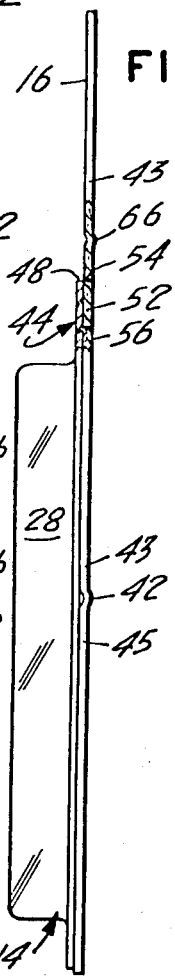
FIG. 2
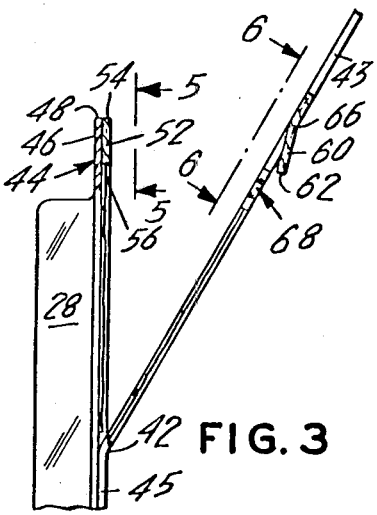
FIG. 3
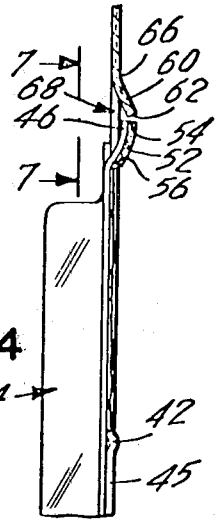
FIG. 4
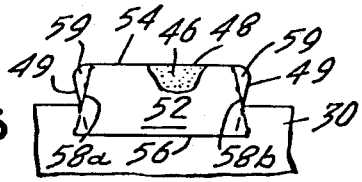
FIG. 5
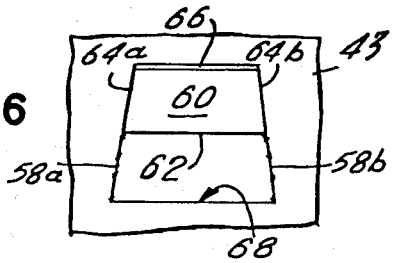
FIG. 6
FIG. 7
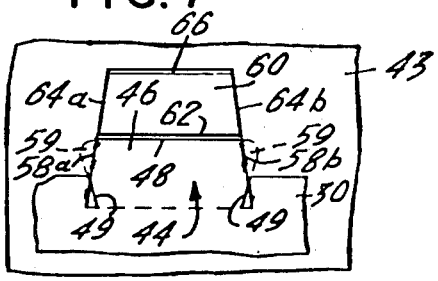

FIG. 11
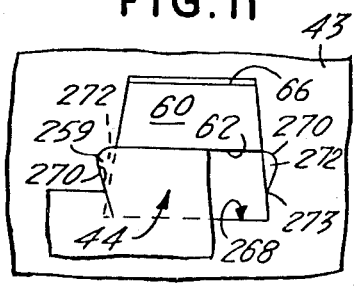
FIG. 12
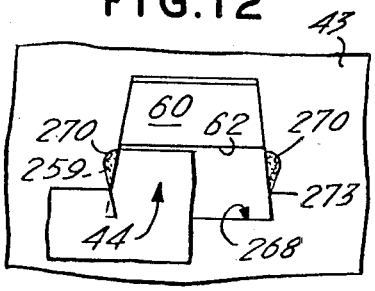
FIG. 8
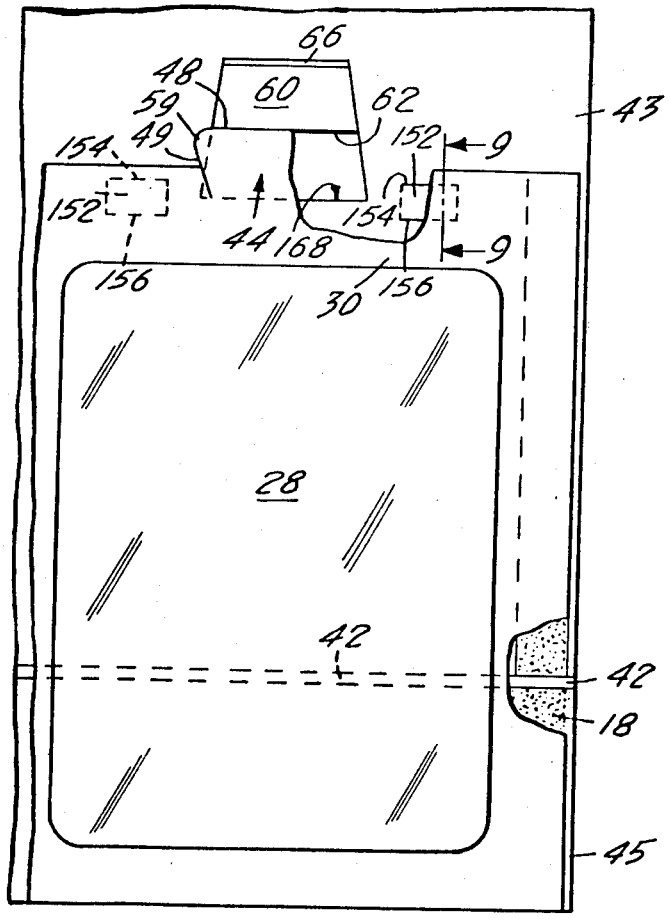
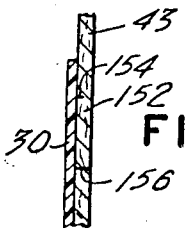
FIG. 9
FIG. 10
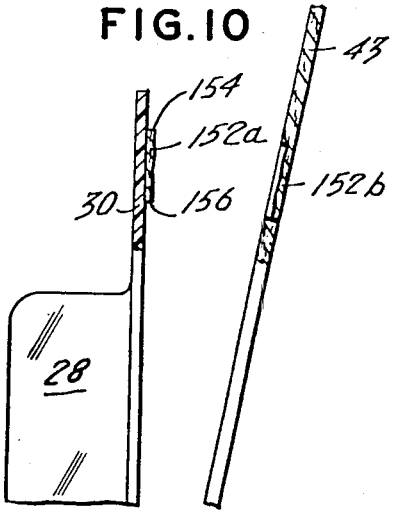

FIG. 13
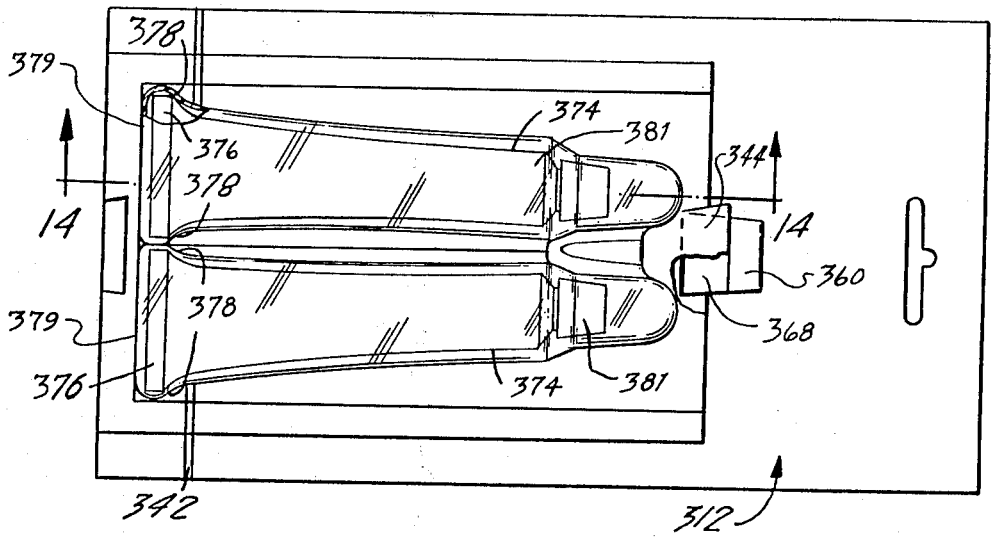
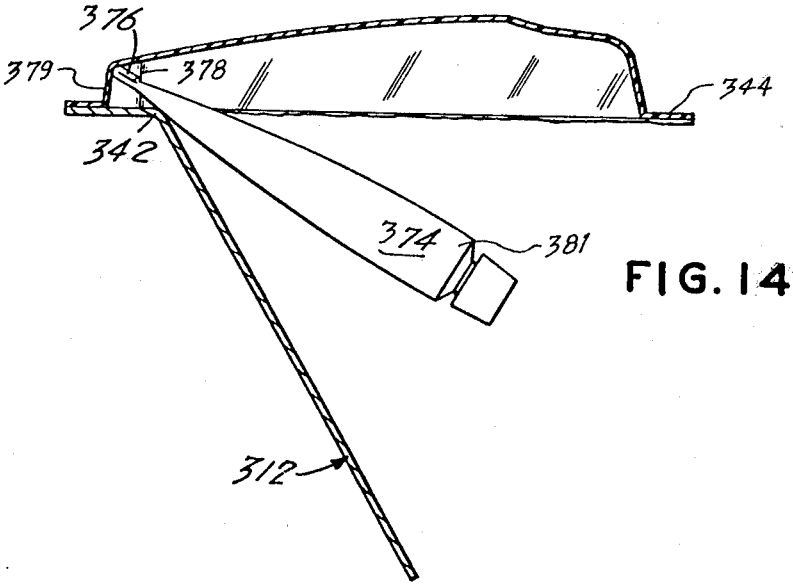
FIG. 14

BLISTER PACKAGE

This is a continuation-in-part of application Ser. No. 040,100, filed May 18, 1979 U.S. Pat. No. 4,236,636, for BLISTER PACKAGE, by Morris W. Kuchenbecker.

BACKGROUND OF THE INVENTION

Blister packages are beneficial to merchandisers in that they provide good product visibility, and therefore attract customer attention to the contained product, in addition to providing bulk to the package, which discourages theft. It is believed that initially all blister packages had complete and uniform adhesion around the flange between the blister and the backing board. When these packages are opened, it is normal for either the board or the blister to be destroyed in the process. In many cases it is desirable that the package be opened with minimal damage to the package. Thus, printed instructions and illustrations are preserved, and the package may continue to serve as a receptacle for the contained product. This is particularly advantageous with multi-use products and products packaged in bulk.

Recloseable blister packages have been developed which, by various means, allow the package to be opened without destruction of either component, and which provide some reclosing feature. A problem with such recloseable blister packages has been that large expanses of the blister flange have intentionally not been affixed to the card when the package is filled and closed. This has been necessitated in packages of the prior art by the need to balance the firm closure of the package with ease and reliability of opening while maintaining the overall integrity of the package.

In particular, the portion of the flange on the opening end of the package has typically been either unaffixed, or adhered with spaced spots of adhesive. Upon opening, spots of adhesive initiate long tears across the face of the board, which damages instructions normally printed on the board, as well as making the product difficult to remove, by leaving strands, or strings, of the front layers of the board attached to the blister flange. In some cases the board is cut scored around the area of the adhesive to provide release of the board spot when the package is opened. In practice, the operation of the cut scored spots has been found to be very sensitive to the depth and uniformity of cut scoring. Cuts made too deep leave insufficient material under the cut to ensure the integrity of the spot with the remainder of the board, and to prevent unintentional release of the blister from the board. Cuts made too shallow, or cuts with slight non-uniformity, can leave a spot which will not separate cleanly from the board and will propagate the tear across the face of the board. Thus frequent adjustments to the cut scoring equipment, and extensive quality testing are necessary in the manufacture of these packages; and the probability of making excessive quantities of unacceptable product is high.

If there are substantial expanses where the blister flange is not affixed to the board, the board and blister flange can be carefully separated a limited distance to create a temporary aperture in the package through which product may be surreptitiously removed, and pilfered. In one development, the portion of the flange on the opening end of the package has been adhered over its entire length, with a cut scored line between the raised product holding portion of the blister and the adhered portion of the flange. As with cut scoring around spots, mentioned earlier, the operation of the cut scored line has been found to be very sensitive, and to respond similarly, to the depth and uniformity of cut scoring.

Thus recloseable blister packages have heretofore been unable to satisfy the requirement of pilferage resistance in combination with a strong and protective package which can be reliably and easily opened. Those providing adequate pilfer resistance cannot be reliably opened. Those easily opened are subject to unacceptable risk of pilferage. Some are neither adequately pilfer resistant nor reliably opened. Further, the packaging of small items, such as washers or pins, in such recloseable blister packages has been impossible because of the tendency of the product to fall out of the package through the expanses where the blister flange and the backing board are not affixed. This packaging application would be ideal if the package design defects could be corrected, since such small items are usually sold in quantities greater than what the consumer normally uses at one time.

Illustrative of recloseable blister packages are U.S. Pat. Nos. 3,127,010; 3,174,621; 3,502,486; 3,800,998; 3,942,640; 4,119,203; 4,133,429; and 4,166,535. A recloseable blister package is also disclosed in application Ser. No. 958,716 filed Nov. 18, 1978, and now allowed. While the packages described in those documents may be functional, they all suffer from some deficiency either of opening reliability or pilfer resistance. It is desirable that they be recloseable; and it is desirable that the opening and reclosure features be more versatile and adaptable for most efficient use of the packages with a variety of products. It is also desirable that the packages provide improved protection against, and indications of, tampering, that they be made as economically as possible, and that their ease of manufacture be maximized. It is further desirable that the package design be adaptable to protect the product against falling out of the package.

It is therefore an object of this invention to provide a novel, versatile and adaptable, easily opened, blister card package which provides opening without excessive damage to the package, and protection against, and indication of, pilferage or tampering.

It is another object to provide a blister package which is easily opened, easily reclosed, and which readily prevents the product falling out.

It is a further object to provide such a package in a form which can be easily manufactured, filled and sealed on existing equipment.

SUMMARY OF THE DISCLOSURE

It has now been found that certain of the foregoing and related objects of the invention are attained in a novel blister package having an opening end defined thereon, and comprising a backing board having an end disposed toward the package opening end, and a blister member, with a product-holding portion defined therein, secured to one surface of the backing board. The blister member has a peripheral flange extending thereabout. The package has, contained therein, a product having an enlarged portion, the blister being dimensioned and configured to interfere with the enlarged portion to inhibit movement of the product toward the opening end. The board has a hinge crease extending thereacross in a direction transverse to the package opening end in the area of the enlarged portion, and substantially between the enlarged portion and the opening end.

In one embodiment, the flange is bonded in surface contact to a securing segment of the backing board in the region of the opening end of the package. The securing segment is bounded by a first cut line extending through the backing board, a second cut line extending into the backing board and substantially underlying at least one portion of the flange. The second cut line is disposed intermediate, and substantially facing, the first cut line and the end of the backing board. Lines of weakness extend along opposite sides of the securing segment between the corresponding ends of the first and second cut lines.

In a particularly advantageous embodiment, the package is recloseable and has a flexible locking tab projecting, at least in part, outwardly beyond the edge of a portion of the flange at the opening end of the package. The package, when opened, has an aperture in the backing board in registry with the tab, the tab being adapted to be pushed through the aperture to effect reclosure of the package.

BRIEF DESCRIPTION OF THE DRAWINGS

FIG. 1 is a plan view of a blister card package of this invention, with parts of the blister broken away to expose the underlying surface of the backing board.

FIG. 2 is a side view taken along line 2—2 of FIG. 1.

FIG. 3 is a fragmentary side view corresponding to that of FIG. 2, showing the package in the opened position.

FIG. 4 is a fragmentary view corresponding to that of FIG. 2, showing the package in the reclosed position, with the tab engaged behind the rear surface of the board.

FIG. 5 is an enlarged fragmentary view of the rear surface of the blister taken along line 5—5 of FIG. 3, with a portion of the adhered segment broken away to show the adhesive material securing the segment to the blister tab.

FIG. 6 is an enlarged fragmentary view taken along line 6—6 of FIG. 3, showing the front surface of the backing board after the package has been opened and the securing segment removed.

FIG. 7 is an enlarged fragmentary view taken along line 7—7 of FIG. 4, showing the front surface of the package after the package has been opened and subsequently reclosed.

FIG. 8 is a fragmentary plan view of a second embodiment of this invention, with parts of the blister flange and tab broken away to show the detail of the underlying backing board.

FIG. 9 is an enlarged fragmentary sectional view of the flange and the corresponding area of the backing board, taken along line 9—9 of FIG. 8.

FIG. 10 is an enlarged fragmentary section of portions of the package of FIG. 8, including those of FIG. 9 and drawn to the scale thereof, showing the package in an opened position.

FIG. 11 is an enlarged fragmentary plan view showing a modified form of the blister card package of this invention, with parts of the blister flange and tab broken away to show the detail of the underlying backing board.

FIG. 12 is an enlarged fragmentary plan view of the package of FIG. 11 in the reclosed position, with parts of the blister flange and tab broken away to show the detail of the underlying backing board.

FIG. 13 is a plan view of still another embodiment of this invention, with part of the blister broken away, showing a blister card package and product, the package and product being cooperatively dimensioned and configured to restrict release of the product.

FIG. 14 is a fragmentary sectional view taken along line 14—14 of FIG. 13, showing the backing board displaced and the product partially disengaged from the product-holding portion of the blister.

DETAILED DESCRIPTION OF THE ILLUSTRATIVE EMBODIMENTS

Turning now to FIGS. 1–7 of the drawings, a recloseable blister card package is composed of two principle components, a backing board generally designated by the numeral 12 and a blister generally designated by the numeral 14. The blister has a central raised product holding portion 28, and a peripheral flange 30 extending thereabout. The bottom and right and left side flange portions are affixed with strong adhesive to the front surface 16 of the board 12, as shown in the cutaway portions of FIG. 1 at 18. The top portion of flange 30 is essentially free of the board.

Separable areas 38*a* and 38*b* of the board surface are defined by cut score lines 40*a* and 40*b* formed in the front surface of the board, and extending partially through its thickness. The lines 40*a* and 40*b* are located along the top portion of the inner and outer edges of the right and left flange portions, and terminate at a creased hinge line 42 formed in the board and extending across the board from the left side edge to the right side edge, dividing the board into a top portion 43 and a bottom portion 45.

The blister top flange portion has a flexible opening and reclosing tab 44. The tab has an enlarged outer portion 46 provided by ears 59 which extend over an area of the card resistant to displacement. The periphery of the tab is defined by an outer edge portion 48, and two side edge portions 49 which connect with outer edge portion 48 and extend, in a converging relationship, toward the raised product-holding portion 28 of the blister.

Underlying and securely adhered to tab 44 is a trapezoidal securing segment 52 of the board. No portion of the board area outside securing segment 52 is adhered to tab 44. The top and bottom edges 54 and 56 respectively of segment 52 are formed by knife cuts completely through the board. Side edges 58*a* and 58*b* are formed by perforations in the board. Side edges 58*a* and 58*b*, then, form the means for retaining segment 52 in the board during the forming and packaging operations.

Hinge panel 60 lies directly above card segment 52 and has a cut bottom edge 62 coincident with the top edge 54 of card segment 52. Side edges 64*a* and 64*b* are also formed by knife cuts. The top edge of hinge panel 60 is formed by a crease 66.

To open the package, the user grasps the tab 44 and lifts the tab and blister outwardly away from the board. To facilitate grasping the tab, hinge panel 60 is pushed rearwardly, as shown in FIG. 3, and a finger is placed partially behind board segment 52; so that, when the tab is lifted, board segment 52 is lifted along with tab 44, tears away from the board at perforated side edges 58*a* and 58*b*, and remains with the blister as shown in FIGS. 3 and 5. As the blister is lifted from the board, the paperboard splits between the cut score lines 40*a* on the left side and between the cut score lines 40*b* on the right side of the package, releasing surface areas 38*a* and 38*b* from the backing board. The splitting of the paperboard progresses along lines 40*a* and 40*b* to hinge crease 42, where lines 40*a* and 40*b* terminate. As the package is opened, the top portion 43 pivots about hinge crease 42, providing access to the package contents as shown in FIG. 3. The bottom portion of the blister remains affixed to the board, and the lower portion of the package thereby continues to serve as a receptacle for holding and retaining the contents of the package. With the package thus opened, a portion of the contents may be removed or dispensed.

The initial securement of locking tab 44 to securing segment 52 in the manufacturing process impedes pilferage by shortening the distance between points of securement of the blister to the board, thus making it more difficult to surreptitiously separate the flange from the board. Such shortening of the unaffixed expanse also enhances the capability of the package to prevent small articles from falling out.

In the process of opening the package, the removal of segment 52 from the board leaves an aperture 68 in the board, as shown in FIG. 6. This aperture serves two functions. First, as the securing segment 52 is removed, the perforations in the segment side edges 58*a* and 58*b* are torn, leaving fibrous edges on both the sides of the segment and the sides of the aperture. These fibrous edges are easily seen against the background of the printed graphics designs, and thus provide an indication of tampering, or pilferage of the product.

Second, the configuration of aperture 68 is defined by cuts 54 and 56 and perforations 58*a* and 58*b* such that, when the package is reclosed, the enlarged outer portion 46 of tab 44 may be pushed through aperture 68. The ears 59 of the enlarged outer portion are thus secured behind the board as shown in FIGS. 4 and 7. Board segment 52, which is adhesively retained on tab 44, tends to reinforce and stiffen the central portion of tab 44; this resists inadvertent deformation of the tab, and consequently its unintentional release from the secured position shown in FIGS. 4 and 7. Nevertheless, the reinforced tab 44 retains sufficient flexibility to allow its intentional release from behind the board.

Thus, the securing segment 52 serves multiple functions. It serves as a means for securely affixing an area of the blister flange to the board. It serves as a means for cleanly and dependably separating the blister flange from the backing board when the package is opened. It serves as a hindrance to pilferage, making surreptitious access to the product more difficult. It serves as a tamper indicator. Finally, it serves as a means for forming an aperture which can be used with a reclosure tab for locking the reclosed package.

Obviously, not all the above functions are necessary to every package. Therefore, certain modifications of the opening and reclosure features may be made, even though some benefits of the segment may be forfeited, in order to provide certain versatility to the package user.

For example FIGS. 8, 9 and 10 show a package which has been modified by providing two securing segments 152 under the flange 30, rather than a single such segment under the tab. The board segment corresponding to 52 in FIG. 1 has been removed in the manufacturing process, creating aperture 168. Since removal from the board of all board material inside the defined boundaries of the securing segments 152 is no longer necessary to create an aperture for closure of the package, lines 154, which are similar to line 54 in FIG. 1, need not extend completely through the board thickness, as shown in FIG. 9. The function of cut line 156, in positively terminating the tear of the segment from the board remains the same. Thus, segments 152 are defined as that portion of the backing board which is removed from the board when the package is opened. The removal is effected by delamination of the backing board as shown at 152*a* and 152*b* in FIG. 10. This modified form of the securing segment continues to serve multiple functions; i.e. securely affixing an area of the flange to the board, cleanly and dependably separating the flange from the board when the package is opened, hindering pilferage and affording tamper indication.

It should be understood that the pairs of lines defining the top and bottom edges of a given segment, namely the pair 54 and 56 of FIG. 1 and the pairs 154 and 156 of FIG. 5, need not be parallel to each other or to the opening end of the backing board. They can be disposed at substantial angles from the parallel, and still function as described herein. The relationships of the dispositions of line pairs to each other and to the corresponding opening end of the backing board can, nevertheless, be described as facing each other; and it is intended that such embodiments be included and defined in that description.

As another example of a modification that can be made, FIGS. 11 and 12 show fragments of a package in which the securing segments 272 are disposed under tab ears 259. Segments 272 are bounded on one side edge by aperture 268, which is formed in the package manufacturing process. The remainder of the side borders of each segment 272 is formed by a cut score 270; which scores converge, with decreasing segment surface area in the direction away from the opening end of the package, terminating substantially at a point 273. When the tab is lifted to open the package, segments 272 delaminate by ply separation. In this embodiment also, the segments 272 are defined as those portions of the board which are removed from the board when the package is opened. The package is reclosed by pushing the tab through aperture 268, to engage the locking ears 259 behind the board.

FIGS. 13 and 14 show yet another embodiment of the invention. The contained product is a pair of tubes 374, each having an end portion 376 enlarged in at least one dimension transverse to the longitudinal dimension of the tube. The plan view of FIG. 13 shows end portion 376 enlarged in the transverse width dimension. While FIG. 13, for purposes of clear illustration, shows end portion 376 flared outwardly as the end of the tube is approached, a gradual tapering outwardly of the tube may be effective in appropriately restraining the product. The fact that tube 374 has a reduced transverse dimension at end portion 376 when viewed from the side as in FIG. 14 is unimportant to the invention so long as it is enlarged in at least one transverse dimension such as that shown in FIG. 13. As will become clear in the following description, the invention is operable so long as any one transverse dimension of end portion 376 is enlarged. Thus, the enlargement could have been shown in the transverse dimension shown in FIG. 14 rather than the transverse dimension shown in FIG. 13; or the enlargement may be of more than one transverse dimension, such as both the transverse dimensions shown in FIGS. 13 and 14.

Whatever the dimensions of the enlarged portion of the product, the blister is configured to conform relatively closely to one enlarged portion of the product in at least one transverse dimension corresponding to one enlarged transverse dimension of the product. At some point between its enlarged end 379, corresponding to the end portion 376 of the product, and hinge 342, the blister compartment containing each tube is smaller in one transverse dimension, as at 378, than the enlarged end portion 376 in the same transverse dimension. Thus, movement of the product is restricted by interference between the enlarged end portion 376 of the tube and the blister at 378, as shown in FIG. 13.

When the package of FIGS. 13 and 14 is opened, the board 312 hinges about creased line 342, exposing a substantial portion of the contents of the package, and freeing tube end 381 from its confinement within the package. End 381 may thus move freely out of confinement in the package, as seen in FIG. 14, and is easily grasped. However, force tending to remove tube 374 from the package is resisted by the interference between the enlarged transverse dimension of end portion 376 and the conforming blister at 378. Thus, as the end 376 of the tube is moved toward the open end of the package, the enlarged transverse dimension of end portion 376 encounters, at 378, the corresponding blister dimension of smaller size. The interference between the blister and the end 376 resists removal of the tube. As additional force is applied to removing the tube from the package, the resilient material in the blister is temporarily deformed sufficiently to allow passage of the tube out of the blister. After removal of the tube, the resiliency of the blister material tends to return the blister to its original shape. If desired the tube may be replaced in the package, and the same resiliency in the blister receives and holds the replaced tube. The package may then be desirably reclosed by means of the tab 344 and aperture 368.

As shown in FIGS. 13 and 14, it is significant that the location of interference at 378 is positioned between hinge line 342 and the enlarged end 379 of the blister. Thus the product encounters the interference before coming out of the confining and restricting space defined by the blister and that portion of the board 312 located between hinge 342 and the closed end of the package. So long as interference is encountered within that space, the product removal is effectively controlled.

The amount of resistance generated by the interference at 378 can be adjusted by cooperative designing of the package and product, and is controlled by the relative sizing of the blister and the tube, and by selection of the package material. Resistance is increased, for example, by either making the blister conform more closely to the tube at 378, or by using a more rigid blister, or by increasing the taper of the tube and blister combination in the area of interference. Resistance is decreased, for example, by enlarging the blister at 378, or by using a more flexible blister, or by decreasing the taper of the tube and blister combination in the area of interference. The following illustration describes a simple test for the optimum amount of resistance generated by the product/package interference in a typical application, such as the tubes of adhesive shown in FIGS. 13 and 14.

With the opened package oriented in space as shown in FIG. 14, the tubes pivot about creased hinge 342 in the board, with the enlarged ends 376 moving upwardly into intimate contact with the blister, and with the free ends hanging downwardly. This pivoting action provides for the ease of grasping the tubes, but is not essential to the invention. In this position, the force of gravity tends to pull the tube downwardly, out of the package. The interference between the package and the product tends to retain the product in the package. As the package is further rotated to orient the tubes 374 in a downwardly direction, the effective force of gravity increases according to triangulation space geometry. The interference between the package and the product provides a resistance sufficiently strong to hold the product in the package when the package is initially opened, as in FIG. 14. As the package is further rotated, toward a position where the tubes would be disposed vertically downward, the force of gravity finally overcomes the resistance caused by the interference, and the tubes fall out of the package. Since the blister is resilient the tubes can be easily replaced in the package, and will be held by the package, as before their removal.

The above illustrated test shows that the package prevents typical spillage of the product after the package is opened; and that the product can be readily removed. That test is, of course, not suitable to all product applications. Thus, with a very heavy product, greater resistance due to the interference may be desirable. With a light product, less resistance may provide the optimum relationship between the product and the package.

Those skilled in the art will appreciate that the interference between the product and the blister may take forms other than a taper. The product may have any enlarged portion, such as a circle, sphere, ellipse, or any of the irregular shapes. The blister then has a conforming shape about the enlarged portion that provides the desired interference with the product when the enlarged portion of the product is positioned between its normal packaged position and its emergence past hinge 342, upon removal.

Thus it can be seen that the present invention furnishes a versatile and adaptable, easily opened blister package which provides controlled opening without excessive damage to the package, and protection against, and indication of, pilferage and tampering. Certain embodiments are surprisingly effective to prevent inadvertent disengagement of the product from the package, and may be designed for optimum effectiveness of retention and dispensing of the product. The packages of this invention are also compatible with, and can be manufactured, filled and sealed on, existing equipment.

Having thus described the invention, what is claimed is:

1. A blister package having an opening end defined thereon comprising: a backing board having an end disposed toward said package opening end; and a blister member, with a product-holding portion defined therein, secured to one surface of said backing board, said blister member having a peripheral flange extending thereabout, said package having contained therein a product having an enlarged portion, said blister being dimensioned and configured to interfere with said enlarged portion to inhibit movement of said product toward said opening end; said board having a hinge crease extending thereacross in a direction transverse to said package opening end in the area of said enlarged portion, and substantialy between said enlarged portion and said opening end.

2. A blister package as in claim 1, said flange being bonded in surface contact to a securing segment of said backing board in the region of said opening end of said package; said securing segment being bounded by a first cut line extending through said backing board, a second cut line extending into said backing board and substantially underlying at least one portion of said flange, said second cut line being disposed intermediate, and substantially facing, said first cut line and said end of said backing board; and lines of weakness extending along opposite sides of said securing segment between the corresponding ends of said first and second cut lines.

3. A blister package as in claim 1 or 2, said package being recloseable and having a flexible locking tab projecting, at least in part, outwardly beyond the edge of a portion of said flange at said opening end of said package, said package when opened having an aperture in said backing board in registry with said tab, said tab being adapted to be pushed through said aperture to effect reclosure of said package.

4. A blister package as in claim 2, displacement of said blister from said backing board on said opening end being effective to open said package and thereby remove said securing segment from the remainder of said backing board, said securing segment comprising at least the surface portion of said backing board, said removal terminating at said first cut line.

5. A blister package as in claim 2, said package being recloseable and having a flexible locking tab projecting, at least in part, outwardly beyond the edge of a portion of said flange at said opening end of said package, said package when opened having an aperture in said backing board in registry with said tab, said tab being adapted to be pushed through said aperture to effect reclosure of said package; displacement of said blister from said backing board on said opening end being effective to open said package and thereby remove said securing segment, said securing segment comprising at least the surface portion of said backing board, from the remainder of said backing board, said removal terminating at said first cut line.

* * * * *